US011111748B2

(12) United States Patent
Mahajan et al.

(10) Patent No.: US 11,111,748 B2
(45) Date of Patent: Sep. 7, 2021

(54) MILLING TOOLS WITH A SECONDARY ATTRITION SYSTEM

(71) Applicant: Wellbore Integrity Solutions LLC, Houston, TX (US)

(72) Inventors: Manoj D. Mahajan, Houston, TX (US); Charles H. Dewey, Houston, TX (US); Shantanu N. Swadi, Cypress, TX (US); Walter E. Friedl, The Woodlands, TX (US); Christopher Kang Potter, The Woodlands, TX (US); Alan Fairweather, Aberdeen (GB); Kenneth Daniel Hora, Houston, TX (US)

(73) Assignee: Wellbore Integrity Solutions LLC, Houston, TX (US)

( * ) Notice: Subject to any disclaimer, the term of this patent is extended or adjusted under 35 U.S.C. 154(b) by 0 days.

(21) Appl. No.: 16/747,510

(22) Filed: Jan. 20, 2020

(65) Prior Publication Data

US 2020/0149364 A1 May 14, 2020

Related U.S. Application Data

(63) Continuation of application No. 14/815,174, filed on Jul. 31, 2015, now Pat. No. 10,538,983.

(60) Provisional application No. 62/034,031, filed on Aug. 6, 2014, provisional application No. 62/034,052, filed on Aug. 6, 2014, provisional application No. 62/153,841, filed on Apr. 28, 2015.

(51) Int. Cl.

| | |
|---|---|
| ***E21B 29/00*** | (2006.01) |
| ***E21B 4/02*** | (2006.01) |
| ***E21B 10/60*** | (2006.01) |
| ***E21B 10/42*** | (2006.01) |

(52) U.S. Cl.

CPC ..... *E21B 29/002* (2013.01); *E21B 4/02* (2013.01); *E21B 10/42* (2013.01); *E21B 10/60* (2013.01)

(58) Field of Classification Search

CPC ..... E21B 29/002; E21B 4/02; E21B 10/42; E21B 10/60

See application file for complete search history.

(56) References Cited

U.S. PATENT DOCUMENTS 3,871,488 A * 3/1975 Sabre ..... E21B 10/56 175/406
4,657,090 A * 4/1987 Geczy ..... E21B 4/003 175/107

(Continued)

*Primary Examiner* — Yong-Suk (Philip) Ro
(74) *Attorney, Agent, or Firm* — Hubbard Johnston, PLLC

(57) ABSTRACT

Milling systems, tools, and methods include using a mill with secondary attrition system to re-mill cuttings and other debris away from the face of the mill. The secondary attrition system may be located uphole of the mill may be used to stage conditioning and re-sizing of debris. After debris is generated by the mill, the secondary attrition system may re-mill the debris to a finer size before allowing the debris to pass out of the sleeve. The debris may be re-milled by secondary cutting elements while within an annular gap positioned radially between the sleeve and a drive shaft for the mill. The annular gap may have a variable width as a result of a tapered outer surface of the drive shaft and/or a tapered inner surface of the sleeve. The variable width may cause debris to be re-milled into increasingly finer sizes.

17 Claims, 6 Drawing Sheets

(56) References Cited

U.S. PATENT DOCUMENTS

| | | | | |
|---|---|---|---|---|
| 5,887,668 | A * | 3/1999 | Haugen | E21B 49/06 175/79 |
| 6,397,959 | B1 * | 6/2002 | Villarreal | E21B 10/54 166/55 |
| 6,427,792 | B1 * | 8/2002 | Roberts | E21B 7/064 175/408 |
| 10,538,983 | B2 * | 1/2020 | Mahajan | E21B 10/42 |

* cited by examiner

MILLING TOOLS WITH A SECONDARY ATTRITION SYSTEM

RELATED APPLICATIONS

This application is a continuation of U.S. application Ser. No. 14/815,174 filed Jul. 31, 2015, which claims the benefit of, and priority to, U.S. Provisional Application No. 62/034,031 filed Aug. 6, 2014, U.S. Provisional Application No. 62/034,052 filed Aug. 6, 2014, and U.S. Provisional Application No. 62/153,841 filed Apr. 28, 2015, which applications are expressly incorporated herein by this reference in their entireties.

BACKGROUND

To increase the production of hydrocarbons, an oil and gas well may be stimulated by using perforating and fracturing processes. Perforation involves forming holes in the casing or liner. In particular, when a zone of interest is identified, holes may be formed by mechanical cutters, explosive charges, or other means to allow fluid communication between the reservoir and the wellbore. After the casing or liner has been perforated, a plug (e.g., a bridge plug or frac plug) may be set in the wellbore for hydraulically isolating the perforated zone from lower zones in the wellbore. By isolating the perforated zone, fracturing fluid pumped into the well may be limited to the particular zone of interest. The fracturing fluid is pumped at a high pressure to fracture the formation at the perforations through the casing or liner. The high pressure of the fracturing fluid propagates a fracture in the formation, which may increase the production of hydrocarbons from that zone of the wellbore.

The process of perforating the casing and isolating the zone of interest may be repeated at multiple locations within a single wellbore. A bridge plug may then be set at the lower end of each zone of interest where perforation and stimulation is to occur. After perforation and fracturing is completed for a zone, the set bridge plug may be removed. Removal of the bridge plugs may occur by using a retrievable bridge plug, or by milling out the bridge plug. The bridge plug may be formed of various different materials (e.g., rubber, composite materials, and metals). Milling the bridge plug may therefore involve using a mill that cuts into different materials with different material properties.

SUMMARY

Embodiments of the present disclosure relate to a secondary attrition system for a milling system. In at least some embodiments, the secondary attrition system may include a sleeve having an inner surface and an outer surface. A tubular component may be located within the sleeve and may have an outer surface. A gap may be defined in a radial space between the inner surface of the sleeve and the outer surface of the tubular component. The gap may have a variable width along a length of the tubular component. A cutting element may be coupled to the inner surface of the sleeve, the outer surface of the tubular component, or both.

According to another embodiment, a method of milling includes generating debris using a mill. A drive shaft may rotate the mill, and the mill may include cutting elements for generating the debris. A secondary attrition system that is longitudinally offset from the mill may be used to re-mill the debris generated by the mill. The secondary attrition system may include a sleeve with an open lower end that receives the debris. A gap of variable width may be formed between an inner surface of the sleeve and an outer surface of the drive shaft, and may be used in re-milling the debris.

In accordance with another embodiment, a downhole milling system includes a motor, a mill, a sleeve, and a cutting element. The motor may include a housing and a drive shaft. The drive shaft may include a tapered section and may rotate relative to the housing. The mill may be coupled to a distal end of the drive shaft while the sleeve may be coupled to the housing of the motor. The housing also may be positioned around a full or partial length of the drive shaft. The cutting element may be coupled to the sleeve, the drive shaft, or both, and may be longitudinally aligned with the tapered section of the drive shaft.

This summary is provided to introduce some features and concepts that are further developed in the detailed description. Other features and aspects of the present disclosure will become apparent to those persons having ordinary skill in the art through consideration of the ensuing description, the accompanying drawings, and the appended claims. This summary is therefore not intended to identify key or essential features of the claimed subject matter, nor is it intended to be used as an aid in limiting the scope of the claims.

BRIEF DESCRIPTION OF DRAWINGS

In order to describe various features and concepts of the present disclosure, a more particular description of certain subject matter will be rendered by reference to specific embodiments which are illustrated in the appended drawings. Understanding that these drawings depict just some example embodiments and are not to be considered to be limiting in scope, nor drawn to scale for each embodiment contemplated hereby, various embodiments will be described and explained with additional specificity and detail through the use of the accompanying drawings in which:

FIG. 2-1 is a partial cross-sectional view of a milling system for milling a plug, in accordance with one or more embodiments of the present disclosure;

FIG. 2-2 is a partial cross-sectional view of another milling system for milling a plug, in accordance with one or more embodiments of the present disclosure;

FIG. 4-1 is a partial perspective view of a milling system with a secondary attrition system for reducing the size of cuttings produced by a mill, in accordance with one or more embodiments of the present disclosure; and FIG. 4-2 is partial cross-sectional view of the milling system of FIG. 4-1, in accordance with one or more embodiments of the present disclosure.

DETAILED DESCRIPTION

In accordance with some aspects of the present disclosure, embodiments herein relate to milling tools. According to other aspects of the present disclosure, embodiments herein relate to downhole tools. More particularly, embodiments disclosed herein may relate to downhole tools and bottom-hole assemblies ("BHA") that include a mill. An example BHA may include a mill for drilling and removing a bridge plug, frac plug, or other similar sealing device or anchor within a wellbore. In still other aspects, embodiments of the present disclosure may relate to secondary attrition systems that operate to re-mill debris (e.g., metal cuttings, elastomeric debris, etc.) away from a face of a mill.

Figure 1:
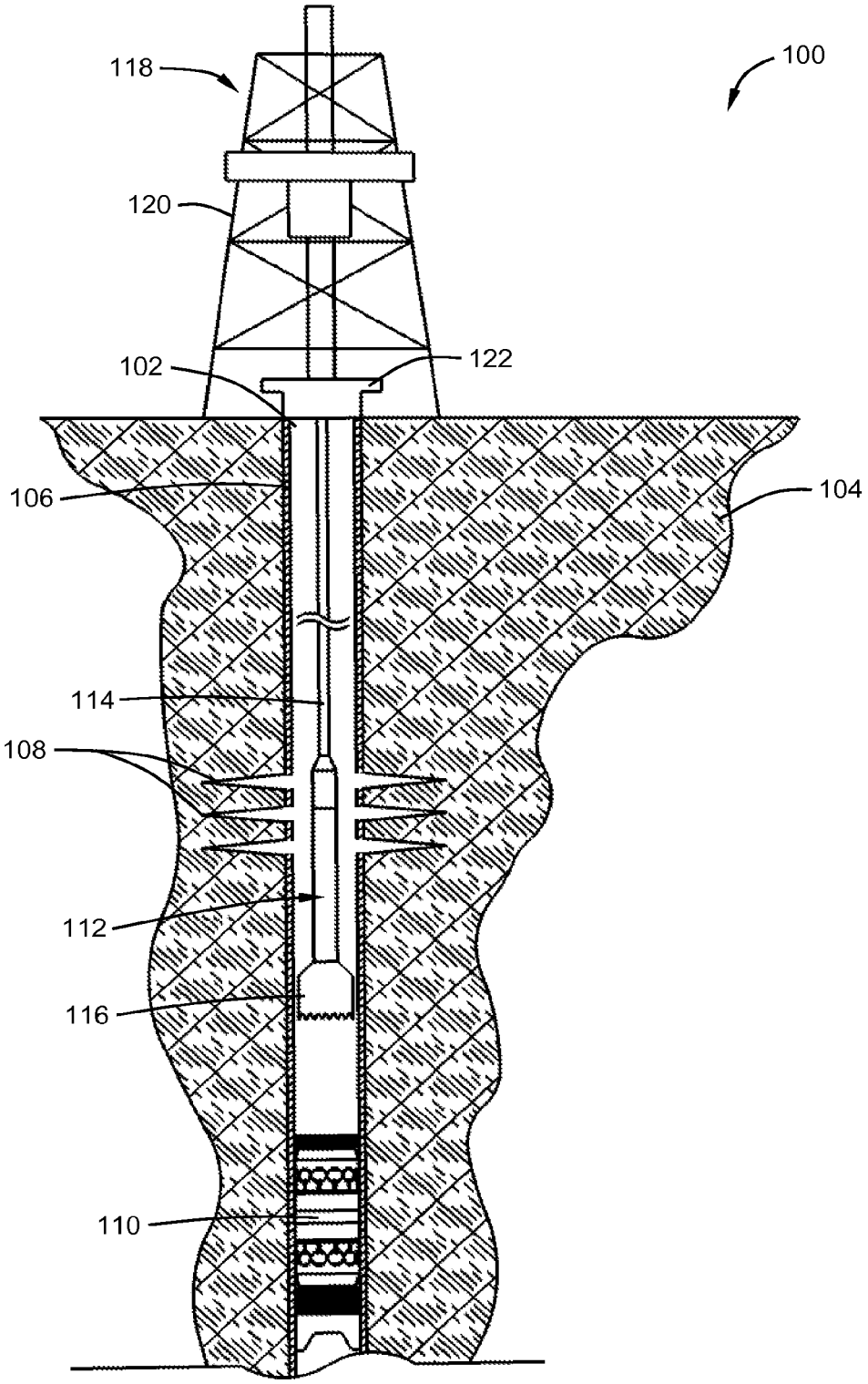
FIG. 1 is a schematic illustration of an example downhole system for milling a plug, in accordance with one or more embodiments of the present disclosure.

Referring now to FIG. 1, a schematic diagram is provided of an example downhole system 100 that may utilize milling systems, assemblies, devices, and methods in accordance with embodiments of the present disclosure. FIG. 1 shows an example wellbore 102 formed in a formation 104. In this particular embodiment the wellbore 102 includes a casing 106 installed therein. The casing 106 may extend along a full length of the wellbore 102; however, in other embodiments, the wellbore 102 may be an openhole wellbore that is uncased, or the wellbore 102 may include both cased portions and openhole portions. Casing 106 within the wellbore 102 may include various types of casing, including surface casing, intermediate casing, conductor casing, production casing, production liner, and the like. In some embodiments, as the depth of the wellbore 102 increases, the diameter of the casing 106 may decrease.

In at least some embodiments, the casing 106 may provide structural integrity to the wellbore 102, isolate the wellbore 102 against fluids within the formation 104, or provide other aspects or features. In some applications, after the casing 106 is cemented or otherwise installed within the wellbore 102, a portion of the casing 106 may be perforated or removed to facilitate or stimulate production in the corresponding portion or zone of the formation 104. In FIG. 1, for instance, perforations 108 may be made in the casing 106 and may extend radially outward into the formation 104. Following formation of the perforations 108, fluid may be pumped into the wellbore 102 and through the perforations 108. The fluid may be pumped in at a sufficiently high pressure to cause the formation 104 to crack or fracture, thereby opening up fluid passageways to stimulate production of hydrocarbons, water, or other fluids in that particular zone within the formation 104. In some embodiments, proppant or other materials may be included in the fluid to assist in fracturing the formation 104 or to hold open the formed fractures.

A plug 110 may be set within the wellbore 102, and in some embodiments the plug 110 may facilitate use of the fluid in fracturing the formation 104. In this particular embodiment, the plug 110 may hydraulically seal a portion of the wellbore 102 below the plug 110 from a portion of the wellbore 102 above the plug 110. As fluid is then pumped into the wellbore 102, the plug 110 may restrict and potentially prevent the fluid from flowing downhole beyond the plug 110 and deeper into the wellbore 102. The fluid may thereby be forced into the formation 104 through the perforations 108. The plug 110 may include a so-called frac plug. A bridge plug may also be used to seal or isolate different portions of the wellbore 102. A frac plug may be a particular type of bridge plug for use in fracturing the formation 104, but bridge plugs may be used in myriad other applications. For instance, bridge plugs may also be used in wellbore abandonment, acidizing, cementing, selective single-zone operations, treatment, testing, repair/remedial, or other applications, or any combination of the foregoing. In other embodiments, the plug 110 may be a non-sealing plug (e.g., an anchor).

In the particular embodiment illustrated in FIG. 1, a BHA 112 may be provided to facilitate milling of the plug 110. Where the plug 110 seals the wellbore 102, milling the plug 110 may open the wellbore 102 and fluidly connect upper and lower zones within the wellbore 102. The BHA 112 may be connected to a drill string 114. In FIG. 1, the drill string 114 is illustrated as extending from the surface and having the BHA 112 suspended therefrom. The drill string 114 may include one or more tubular members. The tubular members of the drill string 114 may themselves have any number of configurations. As an example, the drill string 114 may include segmented/jointed drill pipe or wired drill pipe. Such drill pipe may include rotary shouldered or other threaded connections on opposing ends to allow segments of drill pipe to be connected together to increase the length of the drill string 114 as the BHA 112 is tripped further into the wellbore 102, or disconnected to shorten the length of the drill string 114 and the BHA 112 is tripped out of the wellbore 102. The drill string 114 may also include continuous components such as coiled tubing. Couplings, drill collars, and other drill string components known in the art, or combinations of the foregoing, may also be used.

The BHA 112 may include any number of components that may be used to perform one or more downhole operations. As an example, the BHA 112 may include a bit 116. In at least some embodiments, the bit 116 may be configured or otherwise designed to break-up the plug 110. For instance, the plug 110 may be a composite plug formed of multiple materials (e.g., ferrous materials, non-ferrous materials, composite materials, rubber, elastomers, etc.). The plug 110 may be configured to drill, mill, degrade, or otherwise break-up the different materials of the plug 110. The BHA 112 may also include any number of other components. By way of example, the BHA 112 may include stabilizers, downhole motors (e.g., mud motors, turbines, etc.), mills (e.g., section mills, follow mills, watermelon mills, etc.), logging-while-drilling or measurement-while-drilling components, memory or data storage devices, rotary steerable and directional drilling equipment, activation equipment, data processors and receivers, signal boosters, telemetry components, perforation or fracking equipment, drilling assistance devices (e.g., vibration tools, laser cutting tools, abrasive cutting tools, etc.), other devices or tools, or any combination of the foregoing.

The bit 116 may be a milling bit for milling the plug 110 to remove the plug 110 and open the wellbore 102 to fluid flow between upper and lower portions. The bit 116 may be a lead mill, taper mill, junk mill, or another type of mill that may be used to mill and grind away the plug 110 as the bit 116 is rotated and has weight-on-bit applied thereto. Uphole or downhole rotational power may be provided to rotate the bit 116. A drilling rig 118, for instance, may be used to convey the drill string 114 and BHA 112 into the wellbore 102. In an example embodiment, the drilling rig 110 may include a derrick and hoisting system 120, a rotating system, a mud circulation system, or other components. The derrick and hoisting system 120 may suspend the drill string 114, and the drill string 114 may pass through a wellhead 122 and into the wellbore 102. In some embodiments, the drilling rig 118 or derrick and hoisting system 120 may include a draw works, a fast line, a crown block, drilling line, a traveling block and hook, a swivel, a deadline, or other components. An example rotating system may be used, for instance, to rotate the drill string 114 and thereby also rotate the bit 116 or other components of the BHA 112. The rotating system may include a top drive, kelly, rotary table, or other components that can rotate the drill string 114 at or above the surface.

In other embodiments, the bit 116 may be rotated by using a downhole component. For instance, the BHA 112 may include a motor. The motor may include any motor that may be placed downhole, and expressly may include a mud motor, turbodrill, other motors or pumps, any component thereof, or any combination of the foregoing. A mud motor may include fluid-powered motors such as positive displacement motors ("PDM"), progressive cavity pumps, Moineau pumps, other type of motors, or some combinations of the foregoing. Such motors or pumps may include a helical or lobed rotor that is rotated by flowing drilling fluid. The drill string 114 may include coiled tubing, slip drill pipe, segmented drill pipe, or other structures that include an interior channel within a tubular structure so as to allow drilling fluid to pass from the surface to the BHA 112. In the mud motor, the flowing drilling fluid may rotate the lobed rotor relative to a stator. The rotor may be coupled to a drive shaft which can directly or indirectly be used to rotate the bit 110. In the same or other embodiments, the motor may include turbines or a turbodrill. A turbine-powered motor may be fluid-powered and may include one or more turbines or turbine stages that include a set of stator vanes that direct drilling fluid against a set of rotor blades. When the drilling fluid contacts the rotor blades, the rotor may rotate relative to the stator and a housing of the turbodrill. The rotor blades may be coupled to a drive shaft (e.g., through compression, mechanical fasteners, etc.), which may also rotate and cause the bit 116 to rotate.

Although the downhole system 100 is shown in FIG. 1 as being on land, those of skill in the art will recognize that embodiments of the present disclosure are also equally applicable to offshore and marine environments. Additionally, while embodiments herein discuss milling of a plug within a cased wellbore, in other embodiments a plug may be used in an openhole wellbore, or an openhole section within a wellbore. Further still, components other than plugs may be milled, or milling may occur above the surface rather than in a downhole environment.

Figures 1, 2:
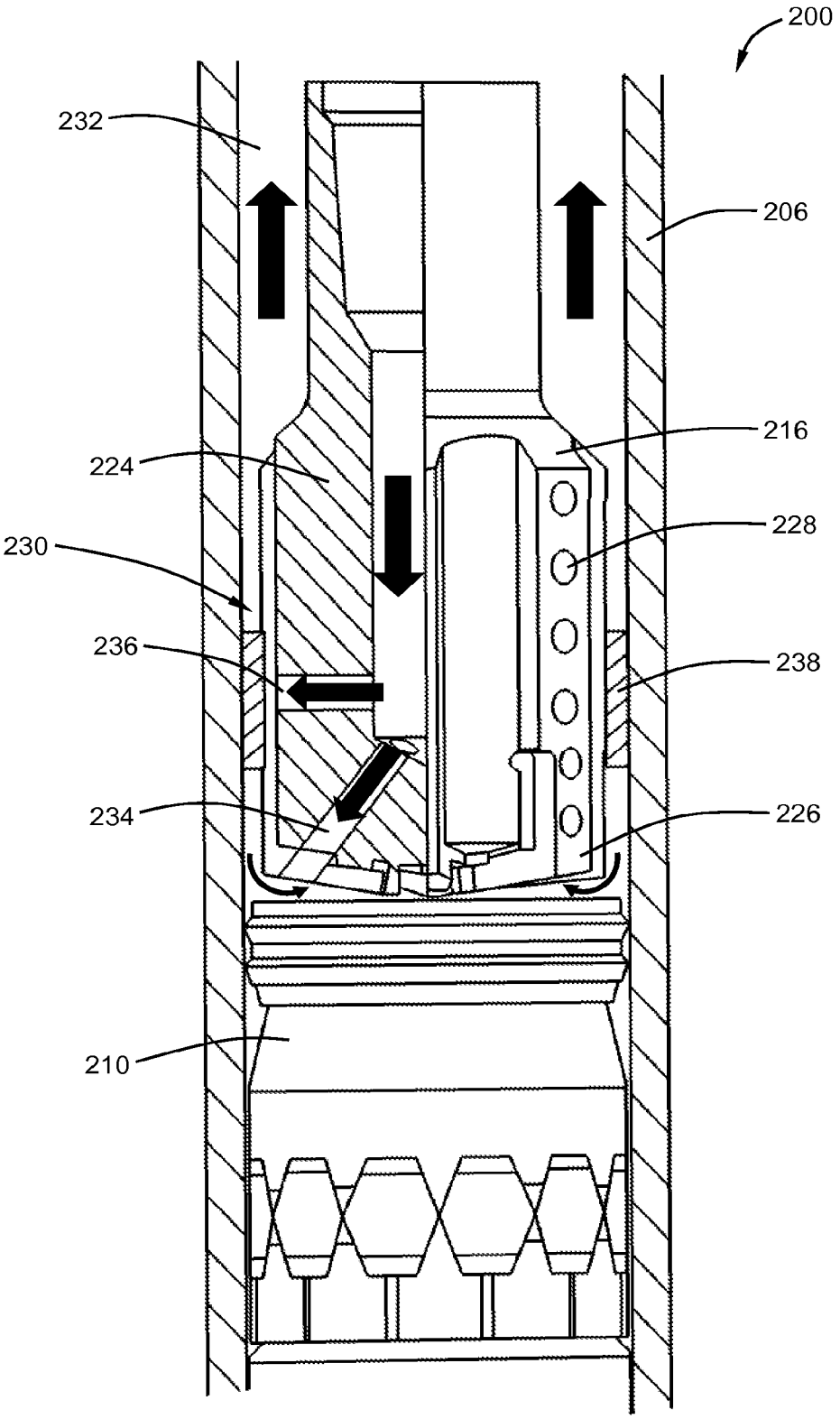
Figure 2:
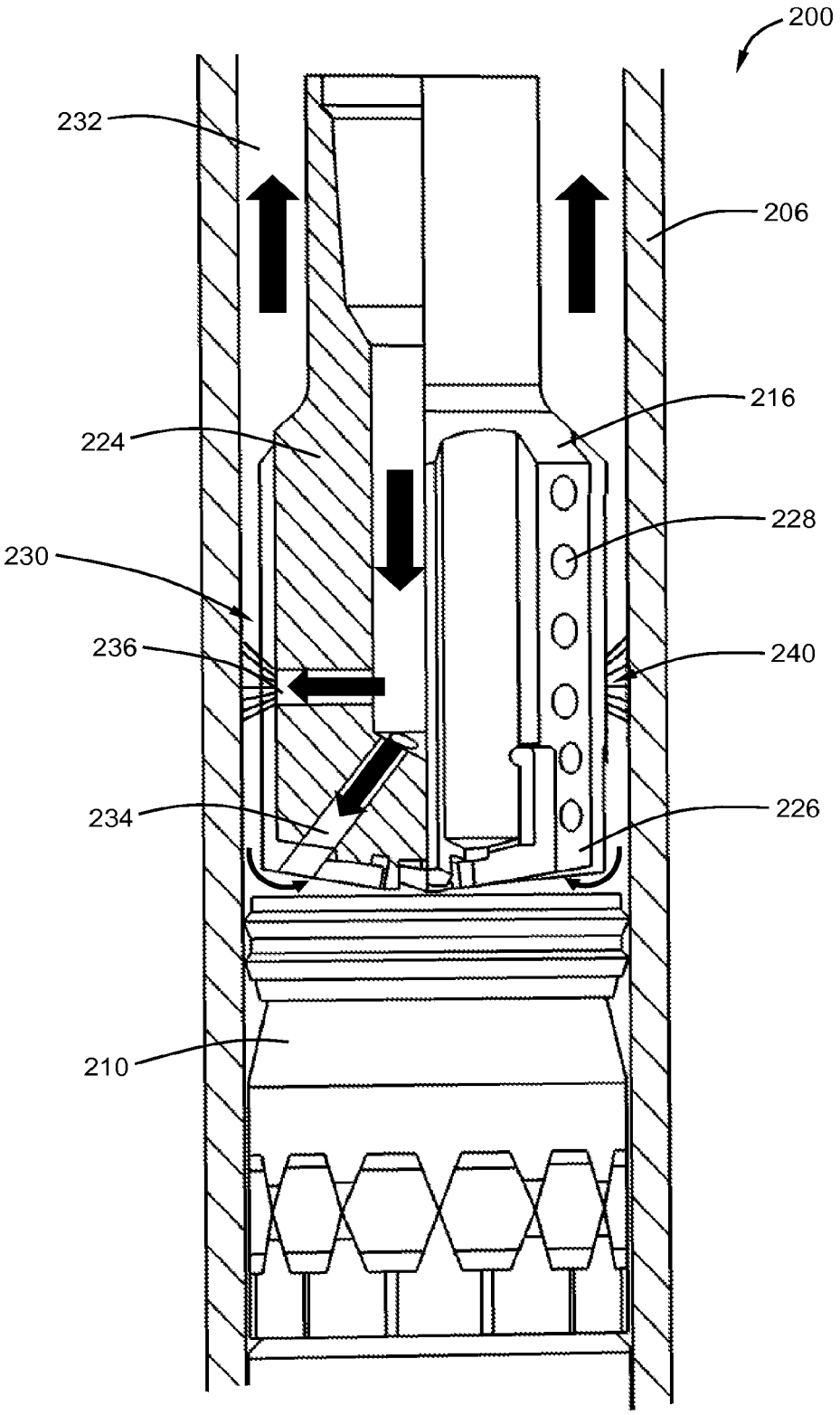

Turning now to FIG. 2-1, a downhole milling system 200 is shown in accordance with some embodiments of the present disclosure. The downhole milling system 200 may include a milling bit such as mill 216 configured for use in milling or otherwise grinding a component or tool (e.g., a plug 210 set within a wellbore). In at least some embodiments, the plug 210 may include a bridge plug. As discussed herein, the plug 210 may be formed of one or more materials and, in some embodiments, may provide a hydraulic seal between an upper portion of the wellbore (i.e., a portion of the wellbore uphole of the plug 210) and a lower portion of the wellbore (i.e., a portion of the wellbore downhole of the plug 210). The plug 210 may be formed of various materials, including metals (e.g., ferrous and non-ferrous metals), alloys, rubber or other elastomers, composite materials, other materials, or combinations of the foregoing.

The mill 216 may be inserted into a wellbore and moved downhole toward, and into engagement with, the plug 210. In at least some embodiments, the wellbore may have a casing 206 lining the inner surface of the wellbore, and the mill 216 may be inserted through the casing 206. For milling of the plug 210, the mill 216 may include a bit body 224 having one or more blades 226, knives, or other cutting structure thereon. These blades 226 or other cutting structures may further include or be coupled to cutting elements 228 configured to grind, mill, degrade, or break-up the plug 210. The blades 226 and the cutting elements 228 may have any suitable configuration. For instance, there may be multiple blades 226 circumferentially spaced around the bit body 224 of the mill 216. Any number of blades 226 may be provided. For instance, there may be between 1 and 20 blades 226 in some embodiments. More particularly, there may be 1, 2, 4, 6, 8, 10, 12, 15, 18, 20 blades, or any value therebetween. In other embodiments, there may be more than 20 blades 226, or there may be no blades and other cutting structures (e.g., roller cones, etc.) may be used. The blades 226 may each be the same, or different, and there may be equal or unequal spacing between the blades 226.

The cutting elements 228 may also have any suitable configuration and make-up. The cutting elements 228 may be formed of a material having sufficient hardness or abrasiveness to grind the plug 210 into cuttings and remove the plug 210 from the wellbore. In some embodiments, the cutting elements 228 may be formed of materials with material properties sufficient to cut steel or other ferrous metals. Examples of suitable materials useful for cutting steel or other ferrous metals may include, by way of illustration, tungsten, titanium, ceramics, metal carbides (e.g., tungsten carbide, cobalt-cemented tungsten carbide, cemented titanium carbide, cemented tantalum carbide), diamond (e.g., polycrystalline diamond), cubic boron nitride (e.g., polycrystalline cubic boron nitride), other so-called "superhard" or "super-abrasive" materials, or any combination of the foregoing. Such materials may also be suitable for cutting non-ferrous metals, alloys, composites, elastomers, and the like. In some embodiments, the cutting elements 228 may be formed as fixed cutters that can be brazed, welded, or otherwise secured within corresponding pockets in the bit body 224. In other embodiments, the cutting elements 228 may be components of hardfacing applied to the blades 226, may be distributed through the bit body 224 (e.g., impregnated), otherwise coupled to the bit body 224, or a combination of the foregoing may be used. For instance, one layer of the bit body 224 may be impregnated with cutting elements while another layer may have fixed cutters coupled to the bit body 224.

In accordance with some embodiments of the present disclosure, the blades 226 and cutting elements 228 may be part of a debris conditioning system 230 of the mill 216. The debris conditioning system 230 may be used to initially mill or grind the plug 210 into cuttings, and to re-grind or further mill the cuttings to have a size, shape, or other configuration that can be efficiently transported to the surface within the annulus 232 between the casing 206 and the mill 216, drill string, and BHA. For instance, drilling fluid flowing uphole within the annulus 232 may provide a solids transport mechanism for carrying the cuttings to the surface.

In operation, drilling fluid may flow through the downhole milling system 200 and may generally follow the block arrows shown in FIG. 2-1. The drilling fluid may, for instance, flow through a drill string (e.g., drill string 114 of FIG. 1) and into an interior channel within the bit body 224 of the mill 216. The bit body 224 may define one or more ports, nozzles, or jets through which drilling fluid may exit the mill 216. For instance, the bit body 224 may include a first nozzle 234 which in the illustrated embodiment may convey drilling fluid from the interior of the bit body 224 to a location near the face of the mill 216. Drilling fluid flowing through the first nozzle 234 may be used to cool the blades 226 or cutting elements 228, and may exit and be jetted from the bit body 224 with sufficient velocity to evacuate cuttings from the face of the mill 216. A single first nozzle 234 is shown in FIG. 2-1; however, one skilled in the art should appreciate in view of the disclosure herein that 1, 2, 3, 4, 5, or more first nozzles 234 may be defined by the bit body 224 and included in the mill 216.

One or more second nozzles 236 may also be defined in the bit body 224 of the mill 216. In the embodiment shown in FIG. 2-1, the second nozzles 236 may cause drilling fluid to exit or be jetted from the mill body 224 in a direction that may be about perpendicular to a longitudinal axis of the mill 216. As indicated by the block arrows, the drilling fluid exiting the mill 216 through the first and second nozzles 234, 236 may enter the annulus 232 and return to the surface. Cuttings from the plug 210 may be suspended in the drilling fluid and also returned to the surface.

In at least some embodiments, the second nozzles 236 may be included as part of the debris conditioning system 230. For instance, as discussed in greater detail with respect to FIG. 2-2, the second nozzles 236 may be used to form a fluid shroud, curtain, or other barrier to restrict, and potentially prevent, cuttings or debris above a predetermined size from moving uphole past the fluid or hydraulic barrier and toward the surface.

In some embodiments, the debris conditioning system 230 may include additional or other components. For instance, FIG. 2-1 illustrates a barrier 238 that may be used to restrict, and potentially prevent, cuttings or debris above a predetermined size from moving uphole past the barrier 238 toward the surface. The barrier 238 may include mechanical or other components. In at least some embodiments, the barrier 238 may include one or more expandable pads. The expandable pads may fill a portion of the annulus 232 between the mill 216 and the casing 206, thereby restricting the area through which debris or cuttings may pass toward the surface. Restricting flow of the debris and cuttings in this manner may be a result of gaps between the barriers 238 and the casing 206, and circumferential gaps between the barriers 238 themselves, having a size sufficient to allow passage of smaller cuttings and debris, while restricting passage of larger pieces.

Where the barriers 238 include expandable pads, the expandable pads may be selectively retractable or extendable. When the mill 216 is inserted into the wellbore, the expandable pads may be in an at least partially retracted state. As the mill 216 reaches the plug 210, the expandable pads may be expanded radially outward toward the casing 206. The expandable pad may pivot, slide along an inclined path, or otherwise move at least partially in a radial direction. Actuation of the expandable pad may occur in any suitable manner. For instance, the mill 216 or other bit or component of a downhole system may include one or more sensors (not shown) that sense weight-on-bit, proximity to the plug 210, or contact with the plug 210. In response to such detection, a mechanical, electrical, hydraulic, or other activation system may be deployed to expand the expandable pads or open a port to allow the drilling fluid in the mill 216 to expand the expandable pads. In other embodiments, actuation may be provided from an uphole actuation signal. The actuation signal may be conveyed using wireless, physical, or other mechanisms, or combinations of the foregoing. For instance, an actuation signal may be conveyed to the mill 216 by dropping a ball or dart which creates fluid pressure to expand the expandable pads. In other embodiments, an active or passive RFID tag may be conveyed from the surface through the drill string and to the mill 216. A wireless receiver may detect the RFID tag and expand the expandable pads. In other embodiments, the plug 210 may include an RFID tag so that proximity to the plug 210 can be detected. In still other embodiments, wireless signals or telemetry (e.g., mud pulse telemetry, pressure pulse patterns, drill string rotation patterns, etc.) may be used to convey an activation signal to the mill 216. The expandable pads of the barrier 238 may also be selectively retractable in a similar manner. For instance, when weight-on-bit, proximity to the plug 210, or contact with the plug 210 falls below a threshold value, the activation system may deactivate and retract the barriers 238. A second ball or dart may also be dropped, wireless or telemetry may be used, or the like.

With the expandable pads or other barriers 238 limiting annular or circumferential space between the barriers 238 and between the barriers 238 and the casing 206, debris larger than the size allowed by the spacing may be restricting the uphole directed flow of the debris or other cuttings from the plug 210 into the annulus 232. Optionally, flow through the second nozzles 236 or even the first nozzles 234 may be used to move the cuttings. As indicated by the curved arrows at the downhole end of the mill 216 in FIG. 2-1, drilling fluid passing through the first and/or second nozzles 234, 236 may cause the blocked cuttings to re-circulate. Re-circulation may push the cuttings back in front of the face of the mill 216 to allow the blades 226 and cutting elements 228 to re-grind and re-mill the cuttings to smaller sizes. The smaller cuttings may then attempt to pass by or through the barriers 238. Some of the cuttings may then be conveyed to the surface while other cuttings may still be too large and may be re-circulated one or more additional times.

While the barriers 238 are illustrated in FIG. 2-1 as being located on or radially adjacent the bit body 224, in other embodiments the barriers 238 may be positioned in other locations. For instance, the barriers 238 may be positioned above the bit body 224 or even above the mill 216. Additionally, while the barriers 238 may include expandable pads, the barriers 238 may include other components that expand, retract, or are fixed in place. Fixed pads, expandable filters or screens, or other components may also be used.

In other embodiments, the barriers 238 may be eliminated or may remain retracted while milling the plug 210. In particular, FIG. 2-2 illustrates a downhole milling system 200 with the barriers 238 (see FIG. 2-1) removed or retracted. In this embodiment, the debris conditioning system 230 may cause drilling fluid flowing through the second nozzles 236 to jet radially outward toward the casing 206 to form a shield, shroud, curtain, or other hydraulic barrier 240 between the outer surfaces of the mill 216 and the inner surface of the casing 206. More particularly, drilling fluid jetting from the second nozzles 236 may create an area of turbulence in the annulus, and may result in formation of a hydraulic barrier 240 which reduces the annular space between the mill 216 and the casing 206. The hydraulic barrier 240 may thereby restrict and potentially preventing cuttings or debris over a particular size (e.g., larger than circumferential gaps between multiple hydraulic barriers 240) from moving uphole past the hydraulic barrier 240 and into the annulus 232. In some embodiments, larger cuttings may not be efficiently conveyed to the surface and/or may clog the wellbore.

As also shown by the curved arrows at the face of the mill 216 in FIG. 2-2, the drilling fluid jetting from the second nozzles 236 may push the larger cuttings toward the face of the mill 216, thereby promoting re-circulation of the cuttings toward the face of the mill 216 re-milling and re-grinding. Re-milling or re-grinding of the cuttings may produce smaller or finer cuttings, or cuttings of a more desirable shape, thereby promoting efficient solids transport within the wellbore. In some embodiments, flexible materials (e.g., elastomers, rubber, etc.) may be more likely than rigid metals, alloys, and the like to be produced in larger sizes. In such embodiments, the debris conditioning system 230 may be configured to primarily recirculate flexible materials of the plug 210 for re-milling and re-grinding. In other embodiments, however, more metals or other rigid materials, or about equal quantities of different materials may be re-circulated. In some embodiments, the hydraulic barrier 240 of FIG. 2-2 may be used in combination with other barriers (e.g., barrier 238 of FIG. 2-1).

The hydraulic barrier 240 may be selectively activated in some embodiments. For instance, one or more check valves may restrict drilling fluid flow so that drilling fluid below a particular flow rate or pressure may not produce the hydraulic barrier 240. In other embodiments, the second nozzles 236 may be open but drilling fluid not meeting specified flow, weight, pressure, or other criteria may not produce a desired hydraulic barrier 240.

The number, location, angle, and other configurations of the second nozzles 236 may be varied to act as control jets that produce desired qualities in the hydraulic barrier 240. A single second nozzle 236 is shown in FIG. 2-2; however, one skilled in the art should appreciate in view of the disclosure herein that 1, 2, 3, 4, 5, 6, 7, 8, 10, 12, 15, or 20 or more second nozzles 236, or any number therebetween, may be defined or included in the bit body 224 and the mill 216. Including more second nozzles 236 may, in some embodiments, reduce the distance between the hydraulic barriers 240. Forming the second nozzles 236 at an angle that is non-perpendicular to the longitudinal axis of the mill 216 or the wellbore may allow re-circulation patterns to change (e.g., downhole directed second nozzles 236 may, in some embodiments, push cuttings downhole more efficiently). The second nozzles 236, and consequently the hydraulic barriers 240, may also be moved to be on-bit or off-bit. When on-bit, as shown in FIG. 2-2, the second nozzles 236 may extend through the bit body 224. In other embodiments, a collar, circulation sub, or other component located uphole of the mill 216 may include the second nozzles 236.

Figure 3:
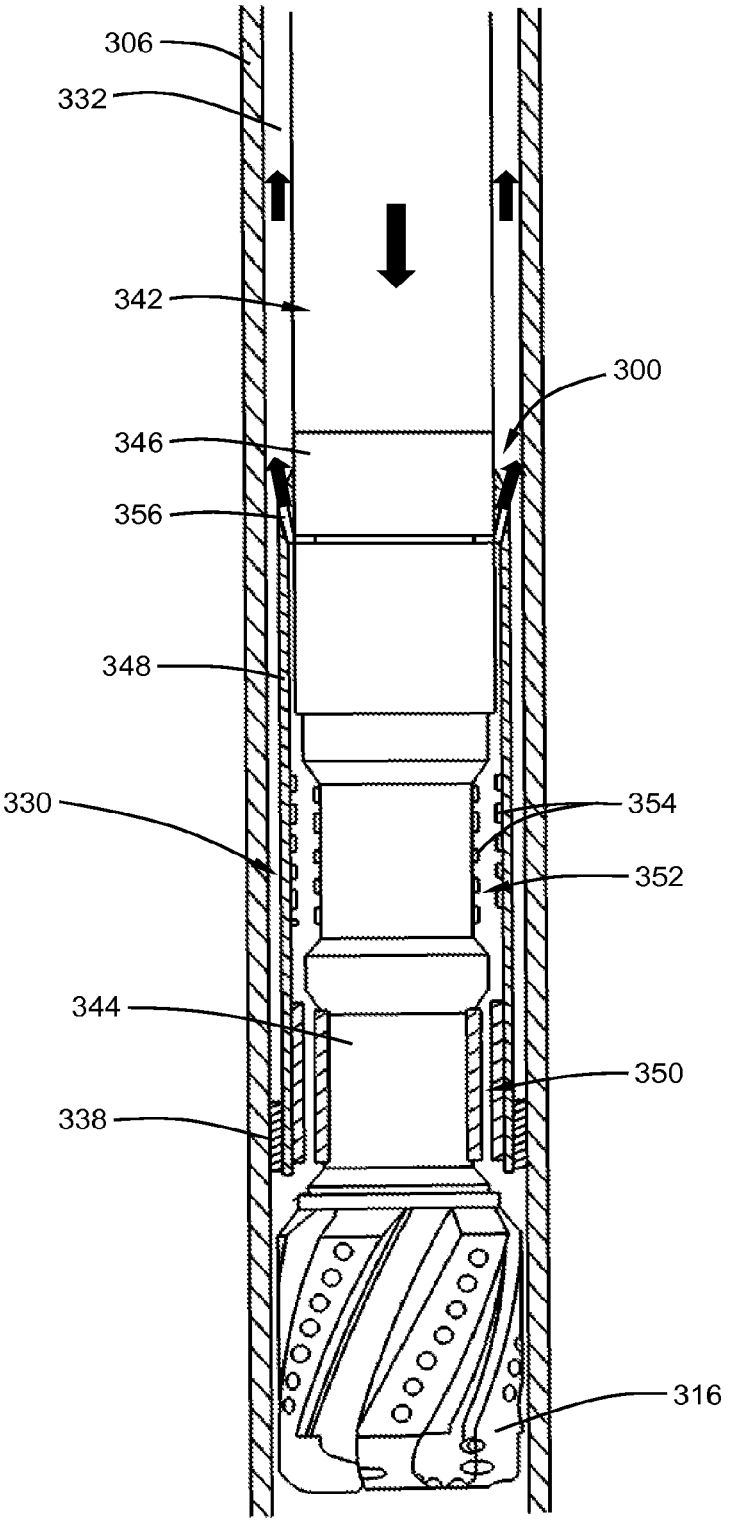
FIG. 3 is a partial cross-sectional view of a milling system with an in-line filtering system for reducing the size of cuttings of a milled plug, in accordance with one or more embodiments of the present disclosure.

Debris conditioning systems of the present disclosure may also be configured to operate in other manners. FIG. 3, for instance, illustrates a downhole milling system 300 that includes a mill 316 and an additional debris conditioning system 330. In at least some embodiments, the debris conditioning system 330 may include one or more components or stages that may be used to reduce the size, change the shape, or otherwise condition debris or cuttings within a wellbore.

In the particular embodiment shown, the downhole milling system 300 and the debris conditioning system 330 may be used within a casing 306 lining a wellbore. The mill 316 may be coupled to the debris conditioning system 330 and a drive system 342 used to rotate the mill 316. As a result, as the mill 316 rotates and engages a downhole component (e.g., a plug), the downhole component may be milled or ground to form debris and cuttings. The drive system 342 may include any number of components. For instance, the drive system 342 may include drill string components that are rotated at the surface of the wellbore. In other embodiments, the drive system 342 may include a mud motor (e.g., a PDM, progressive cavity pump, Moineau pump, etc.), turbines, or a turbodrill. In an embodiment in which the drive system 342 includes a mud motor, turbines, or a turbodrill, drilling fluid flowing through the downhole tool 300 may cause internal rotors to rotate to drive a drive shaft 344 coupled to the mill 316. The drive shaft 344 may extend through at least a portion of the drive system 342, and optionally through a housing 346 which may remain stationary, or which may have a rotation that is different than that of the drive shaft 344. The debris conditioning system 330 may be coupled to the housing 346 in some embodiments.

The mill 316 may be coupled to a downhole end portion of the drive shaft 344 and rotated to mill into, and grind away, a plug or other downhole component or tool (e.g., plug 210 of FIG. 2-2). The cuttings and debris produced by the mill 316 may be of a size that can be conveyed to the surface through drilling fluid within the annulus 332 between the outer surface of the downhole milling system 300 and an internal surface of a casing 306 of the wellbore. In other embodiments, the cuttings or debris, or a portion thereof, may have a size or shape that is not easily conveyed to the surface. As a result, multiple short-trips could be used to avoid plugging or clogging the annulus 332 of the wellbore.

In some embodiments, the debris conditioning system 330 may be used to reduce the number of short-trips by, for instance, re-milling, re-grinding, re-shaping, or otherwise conditioning the debris within the wellbore. As discussed herein, one mechanism for conditioning the debris or other cuttings may include the use of a barrier that promotes re-circulation of cuttings to the face of the mill 316. Mechanical pads, hydraulic jets, or other components discussed herein may therefore be included to define a barrier, curtain, or other device to limit the size of cuttings that may pass uphole, while further re-directing larger cuttings and debris back to the face of the mill 316 for re-grinding and re-milling. As discussed herein, such barriers may be located on or above the mill 316. In FIG. 3, for instance, a barrier 338 may be located above the mill 316.

More particularly, FIG. 3 illustrates an example embodiment in which a sleeve 348 may be coupled to the housing 346. Where the housing 346 is stationary, the sleeve 348 may also be stationary. In at least one embodiment, the housing 346 may be a housing of a mud motor, turbine, turbodrill, or other component of a drive system 342, and one or more connectors may be used to couple the housing 346 to the sleeve 348. For instance, external, pin threads may be formed on the outer surface of the housing 346 while corresponding internal, box threads may be formed on the inner surface of the sleeve 348. The sleeve 348 may then be threadingly coupled to the housing 346. In other embodiments, mechanical fasteners (e.g., screws, bolts, etc.), welding, other fastening techniques, or a combination of the foregoing, may be used to couple the sleeve 348 to the housing 346.

The barriers 338 may be permanently or temporarily used to block a portion of the annulus of the wellbore or to otherwise limit the passage of debris and cuttings uphole past the barriers 328. The barriers 338 may, for instance, be formed in or coupled to the sleeve 348 to occupy at least some of the space between the outer surface of the sleeve 348 and the inner surface of the casing 306. The barriers 338 may not be retractable and may therefore permanently be positioned in an expanded or active state. In other embodiments, the barriers 338 may operate as discussed herein, or otherwise be selectively expanded and/or retracted. For instance, the barriers 338 may include expandable pads that can expand or retract in response to hydraulic, mechanical, electrical, or other forces or signals. In still other embodiments, the barriers 338 may be formed using control jets, nozzles, or the like. For instance, as drilling fluid passes through the drill string, the drilling fluid may be routed inside the sleeve 348. Jets or nozzles corresponding to the position of the barriers 338 may then be used to expel the drilling fluid into the annulus and create a region of turbulence to form a fluid curtain, shroud, or other barrier 338 within at least a portion of the interior of the wellbore. This barrier 338 may be a hydraulic barrier that pushes down cuttings and debris toward the face of the mill 316 and thereby promotes re-circulation of at least some of the cuttings produced by the mill 316.

In at least some embodiments, the barrier 338 may be formed between the inner surface of the casing 306 and the outer surface of the shroud, barrel, or other device forming the sleeve 348. Optionally, the sleeve 348 may extend downhole from the housing 346 but may fully to the mill 316 so that an axial separation may be formed between the mill 316 and the distal or downhole end of the sleeve 348. When debris and cuttings are milled or re-milled to have a shape and/or size suitable for solids transport within the drilling fluid, the debris and cuttings may pass uphole from the mill 316 and into the sleeve 348 to be carried to the surface. The sleeve 348 is optional, and may be omitted in other embodiments. For instance, the internal diameter of the casing 306 may be used as part of the debris conditioning system 330. As an example, the mill 316 may include crushed carbide or other cutting elements on the back of a blade, on the front of one or more gauge pads, and the like. Debris, cuttings, and the like that are between the blade and the casing 306 may then be milled and re-milled by the mill 316 even in the absence of the sleeve 348. Re-circulation may therefore be used to re-circulate cuttings, debris, and the like to the face of the mill 316, to the back of the blades, to gauge portions that include cutting elements, or any combination of the foregoing.

To further condition the debris, promote re-circulation of debris and cuttings, or restrict the size of cuttings and debris passing to the surface, the debris conditioning system 330 may optionally include a filtering system 350. In FIG. 3, for instance, the filtering system 350 may be coupled to the interior surface of the sleeve 348 and/or to the outer surface of the drive shaft 344. The filtering system 350 may include a screen, slots, or other components configured to limit, and potentially prevent, debris and cuttings over a predetermined size from passing into the sleeve 348. For instance, cuttings having a diameter greater than a distance between slots of the filtering system 350, or greater than openings of a screen of the filtering system 350, may be restricted from passing through the filtering system 350. Optionally, such cuttings may be re-circulated to the face of the mill 316 (e.g., through drilling fluid, nozzles, jets, hydraulic barriers, etc.) for re-milling. In some embodiments, the filtering system 350 may be an in-line filtering system within the sleeve 348.

The debris and cuttings that are sufficiently small to pass through the filtering system 350 may be carried by drilling fluid to the surface. In at least some embodiments, however, the debris conditioning system 330 may include a secondary attrition system 352 which may be uphole relative to the filtering system 350 and/or the mill 316. The secondary attrition system 352 may operate as a secondary stage (the mill 316 being a first stage) for further refining the shape or size of the debris and cuttings. The secondary attrition system 352 may thus be considered a secondary reduction system 352 for reducing the size of debris and cuttings away from the mill 316. In FIG. 3, for instance, the interior surface of the sleeve 348 and/or the outer surface of the drive shaft 344 may include secondary cutting elements 354. The secondary cutting elements 354 may be positioned within the sleeve 348 and configured to re-mill and re-grind cuttings that pass through the filtering system 350. The secondary cutting elements 354 may therefore re-mill and re-grind the cuttings and debris away from the bit (e.g., mill 316).

The secondary cutting elements 354 may refine the size of cuttings and debris through grinding and attrition, and may operate using abrasive, cutting, or other action. For instance, the cutting elements 354 may be included in hardfacing applied to the sleeve 348 and/or the drive shaft 344. In other embodiments, the cutting elements 354 may be part of an abrasive slurry. In still other embodiments, crushed carbide may be welded, brazed, or otherwise coupled to the interior surface of the sleeve 348 and/or the outer surface of the drive shaft 344 to facilitate debris grinding action. In at least some other embodiments, hardfacing, discrete cutting inserts, grooves, splines, teeth, or the like may be used as the cutting elements 354. In such an embodiment, the cutting elements 354 may be spaced radially, angularly, and linearly. Thus, as the drive shaft 344 rotates relative to the sleeve 348, debris and cuttings may collect within the voids between the cutting elements 354, and may be crushed as the voids change location and shape by virtue of the rotating cutting elements 354.

In some embodiments, debris and cuttings may be milled by staged cutting structures within the sleeve 348. For instance, multiple sets of cutting elements 354 may be provided, which each set being configured to reduce the size of debris and cuttings to a particular target size. In some embodiments, the filtering system 350 may be removed and replaced by an additional secondary attrition system.

When debris and cuttings have passed through the secondary attrition system 352, and optionally been milled or ground to a desired size, the debris and cuttings may be conveyed to the surface. For instance, drilling fluid may carry the debris and cuttings to the surface. As shown in FIG. 3, the sleeve 348 may include one or more openings 356. The openings 356 may operate as exit ports to allow debris and cuttings to escape from the interior of the sleeve 348 and into the annulus 332. In some embodiments, the debris and cuttings that pass through the openings 356 may have a predetermined maximum size. For instance, the secondary attrition system 352 may be configured to reduce the size of the cuttings and debris to a maximum size that may be about equal to the distance between cutting elements 354 (e.g., axial distance between cutting elements 354 or radial distance between cutting elements 354), or the distance between the outer surface of the sleeve 348 and the inner surface of the casing 306.

Figures 1, 4:
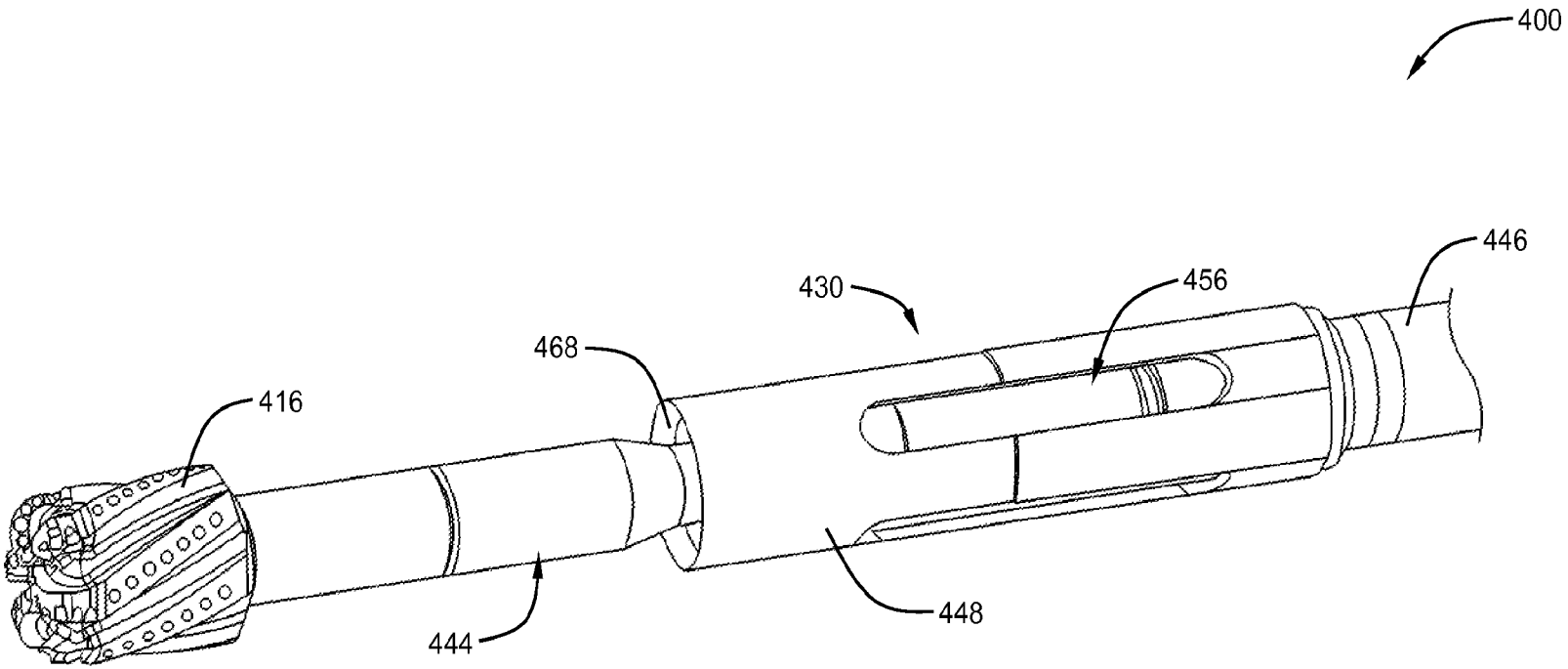
Figures 2, 4:
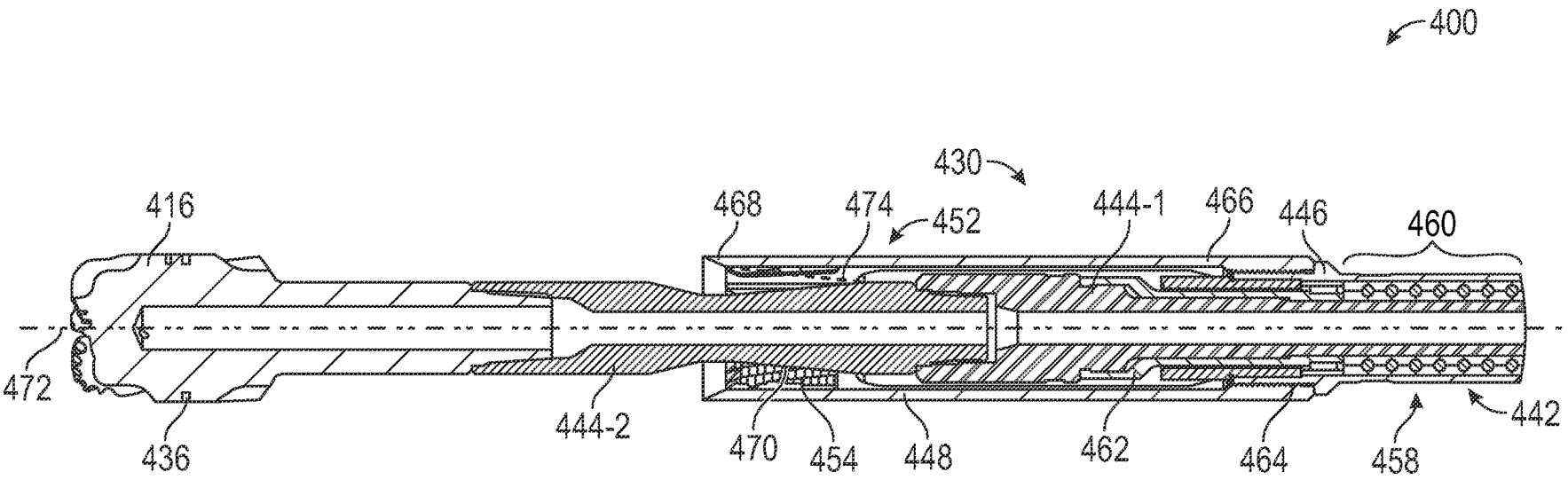

FIGS. 4-1 and 4-2 illustrate still another example embodiment of a milling system 400 for milling and re-milling debris or other cuttings. The milling system 400 of FIGS. 4-1 and 4-2 may be used in any number of different environments. For instance, in at least some embodiments, the milling system 400 may be a downhole milling system.

In this particular embodiment, the milling system 400 may include a mill 416 and a debris conditioning system 430 for collectively milling and re-milling a plug or other component. More particularly, the mill 416 and the debris conditioning system 430 may collectively define multiple stages that may be used to reduce the size, change the shape, or otherwise condition debris or cuttings within a wellbore.

In the particular embodiment shown, the milling system 400 may include a drive system 442 coupled to the debris conditioning system 430 and the mill 416. The drive system 442 may be used to rotate the mill 416 to grind and mill a plug or other component. The drive system 442 may include any number of components. For instance, the drive system 442 may include drill string components that are rotated at the surface of a wellbore. In other embodiments, the drive system 442 may include a mud motor (e.g., a PDM, progressive cavity pump, Moineau pump, etc.), turbines, or a turbodrill. In an embodiment in which the drive system 442 includes a mud motor, turbines, a turbodrill, or other downhole motor, drilling fluid may cause internal rotors to rotate to drive a drive shaft 444 coupled to the mill 416.

In some embodiments, the drive shaft 444 may extend at least partially through the drive system 442. More particularly, as shown in FIG. 4-2, an upper drive shaft 444-1 may extend through a bearing section 458 of the drive system 442. The bearing section 442 may be coupled to, and optionally located within, a housing 446, and may include a bearing stack 460 and a bearing sleeve 462. As shown, the bearing stack 460 and/or the bearing sleeve 462 may be external relative to the upper drive shaft 444-1. The bearing section 458 may be configured to allow the upper drive shaft 444-1 to rotate relative to a housing 446 of the drive system 442. For instance, the bearing stack 460 and/or the bearing sleeve 462 may include one or more radial bearings, bushings, or the like to allow the upper drive shaft 444-1 to rotate while the housing 446 either doesn't rotate or rotates at a different speed. The upper drive shaft 444-1 may rotate at a higher rotational speed relative to the housing 446.

While the bearing section 458 may allow or facilitate relative rotation between the upper drive shaft 444-1 and the housing 446, the bearing section 458 may also perform additional or other functions. For instance, the bearing stack 460 may include one or more thrust bearings. Thrust bearings may be used, for instance, to absorb axial loads produced by a mud motor or turbine, or to otherwise provide shock or axial load resistance.

The upper drive shaft 444-1 may be a tubular component extending through the drive system 442 and directly coupled to the mill 416 (e.g., at a distal end of the upper drive shaft 444-1 by a threaded or welded connection to a stem of the mill 416). In other embodiments, one or more intermediate shafts may couple the upper drive shaft 444-1 to the mill 416. In some embodiments, such as that shown in FIG. 4-2, the upper drive shaft 444-1 may be a tubular component coupled (e.g., threaded or welded) to a drive shaft extension 444-2, which may be an intermediate shaft or mandrel. The drive shaft extension 444-2 may then be coupled directly to the mill 416. In other embodiments, multiple drive shaft extensions 444-2 may couple the upper drive shaft 444-1 and the drive system 442 to the mill 416.

The manner and positioning of connecting the drive shaft extension 444-2 to the upper drive shaft 444-1 may vary in different embodiments. For instance, FIG. 4-2 illustrates an embodiment in which an interface between the upper drive shaft 444-1 and the drive shaft extension 444-2 is longitudinally aligned with, and located within, the sleeve 448. In other embodiments, a drive shaft extension 444-2 may be coupled to an upper drive shaft 444-1 (or another drive shaft extension) at a location that is above or below the sleeve 448. In the illustrated embodiment, the upper drive shaft 444-1 is shown as including a box for mating with a pin of the drive shaft extension 444-2; however, in other embodiments, the upper drive shaft 444-1 may include a pin for mating with a box of the drive shaft extension 444-2, both the upper drive shaft 444-1 and the drive shaft extension 444-2 may include pins to be coupled together with a coupling, or other connection mechanisms may be used.

FIGS. 4-1 and 4-2 further illustrate an example embodiment in which the debris conditioning system 430 may include a sleeve 448 defining an outer barrier for use in directing or limiting flow of debris or cuttings produced by the mill 416. For instance, when the milling system 400 is used within the wellbore, debris and cuttings produced by the mill 416 may flow in an upward or uphole direction into the sleeve 448.

In at least some embodiments, the sleeve 448 may not rotate, or may rotate at a different speed (or in a different direction) than the drive shaft 444 and/or the mill 416. In at least one embodiment, the sleeve 448 may be coupled to the housing 446 of the drive system 442, and the housing 446 and the sleeve 448 may be rotationally fixed relative to each other. For instance, the sleeve 448 may be threadingly coupled to the drive system 442. By way of example, in the illustrated embodiment, a lower portion 464 of the housing 446 may be coupled to an upper portion 466 of the sleeve 448 using a threaded connector. For instance, the lower portion 464 of the housing 446 may be externally threaded to form a male or pin connector for mating with corresponding threads of a female or box connector on the upper portion 466 of the sleeve 448. In other embodiments, the pin-and-box relationship may be reversed, an external coupling may be used to couple together two pin connectors, or mechanical fasteners (e.g., screws, bolts, etc.), welding, or other fastening techniques may be used to couple the sleeve 448 to the drive system 442 or other component of the milling system 400.

The sleeve 448 may include, or cooperate with, one or more structures that can be used to further mill, grind, or condition debris and cuttings produced by the mill 416. For instance, as a plug or other component is milled by the mill 416 to produce cuttings, drilling fluid may carry the cuttings into the interior of the sleeve 448. More particularly, the drilling fluid may flow into an open lower end 468 of the sleeve 448. Optionally, one or more secondary attrition systems 452 may be provided within the sleeve 448 to further mill or grind the cuttings. FIG. 4-2, for instance, illustrates a secondary attrition system 452 that is axially offset from the mill 416, and which may be used to receive the cuttings and debris produced from the mill 416 and mill or grind the cuttings and debris into a finer size. When the debris and cuttings milled by the secondary attrition system 452 are of a size small enough to pass through the lowermost secondary attrition system 452, the debris and cuttings may then be carried by the drilling fluid to one or more openings 456. While a single secondary attrition system 452 is shown in FIG. 4-2, in other embodiments multiple secondary attrition systems may be used. For instance, re-milling of debris and cuttings may be staged so that subsequent stages of secondary attrition systems may reduce the cuttings and debris to even finer sizes.

The secondary attrition system 452 may include cutting elements 454 or other structures suitable to refine the size or shape of cuttings and debris through grinding and attrition, and may operate using abrasive, cutting, or other action. For instance, the secondary attrition system 452 may include cutting elements 454 included in hardfacing applied to the sleeve 448 and/or the drive shaft 444. In other embodiments, the cutting elements may be part of an abrasive slurry. In still other embodiments, crushed carbide may be welded, brazed, or otherwise coupled to the interior surface of the sleeve 448 and/or to a longitudinally aligned portion of the outer surface of the drive shaft 444. Thus, as drilling fluid carries the debris and cuttings through the sleeve 448, the cutting elements 454 may engage, grind, and mill the debris and cuttings to produce finer sizes of debris and cuttings. In at least some other embodiments, discrete cutting inserts, grooves, splines, teeth, or the like may be used as the cutting element 454 of the secondary attrition system 452. In such an embodiment, the cutting elements 454 may be spaced radially, angularly, and linearly. Thus, as the drive shaft 444 rotates relative to the sleeve 448, debris and cuttings may collect within the voids between the offset cutting elements 454, and may be crushed as the voids change location and shape by virtue of the rotating cutting elements.

In some embodiments, the drive shaft 444 and/or the sleeve 448 may cooperate with each other to gradually reduce the size of cuttings and debris. As shown in FIG. 4-2, for instance, the drive shaft extension 444-2 may not have a uniform cross-sectional size or shape. More particularly, the drive shaft extension 444-2 may include a tapered section 470. In this particular embodiment, the tapered section 470 may be longitudinally aligned with the cutting elements 454. The tapered section 470 may be tapered radially inward such that the diameter of the tapered section 470 reduces nearer the opening in the lower end 468 of the sleeve 448. As a result, the annular gap between the outer surface of the drive shaft extension 444-2 and the inner surface of the sleeve 448 may be larger near the opening in the lower end 468 of the sleeve 448 than at an upper end of the cutting elements 454. Such a configuration may form a wedge that mills and grinds debris and cuttings between the sleeve 48 and the drive shaft extension 444-2 and into increasingly smaller sizes as the cuttings and debris move in an uphole direction.

In other embodiments, the drive shaft extension 444-2 and/or the sleeve 448 may be otherwise configured. For instance, an inner surface of the sleeve 448 may be tapered radially inward (e.g., along dashed line 474) to reduce the internal diameter of the sleeve 448 nearer the opening in the lower end 468 thereof. In other embodiments, both the inner surface of the sleeve 448 and the outer surface of the drive shaft extension 444-2 may be tapered. Moreover, the shape of a tapered portion of the drive shaft extension 444-2 and/or the sleeve 448 may be different in various embodiments. FIG. 4-2, for instance, shows a linear taper. The severity of a linear taper may vary, and in some embodiments may be at an angle that is between 2° and 60° relative to a longitudinal axis 472 of the milling system 400. More particularly, the angle of the linear taper of the tapered section 470 may be within a range that includes lower and/or upper limits including any of 2°, 3.5°, 5°, 7.5°, 10°, 15°, 25°, 30°, 45°, 60°, and any values therebetween. For instance, the angle of the taper may be less than 10°, at least 2°, between 2° and 15°, between 5° and 30°, and the like. In other embodiments, a taper angle may be less than 2° or greater than 60°. In still other embodiments, a tapered section 470 of the drive shaft extension 444-2 (or of the upper drive shaft 444-1) may be tapered by including one or more stepped features, parabolic or other curved tapers, other features to stage or gradually reduce sizes of cuttings and debris, or some combination of the foregoing.

When debris and cuttings have passed through the secondary attrition system 452, and optionally been milled or ground to a desired size, the debris and cuttings may be conveyed away from the debris conditioning system 430 and the mill 416. In a downhole environment, for instance, drilling fluid may carry the debris and cuttings to the surface. As shown in FIG. 4-1, the sleeve 448 may include one or more openings 456. The openings 456 may operate as exit ports to allow debris and cuttings to escape and exit from the interior of the sleeve 448 and into an annulus of a wellbore. In some embodiments, the debris and cuttings that pass through the openings 456 may have a predetermined maximum size. For instance, the secondary attrition system 452 may be configured to reduce the size of the cuttings and debris to a maximum size that may be about equal to the minimum radial distance between cutting elements 454 on the sleeve 452 and cutting elements on a corresponding location of the drive shaft 444. In other embodiments, the maximum size of the cuttings and debris may be about equal to a radial distance between the outer surface of the sleeve 448 and an inner surface of a wellbore, or casing within a wellbore.

Whether the mill 416 is coupled directly or indirectly to the upper drive shaft 444-1, the mill 416 may be rotated to mill into, and grind away, a plug or other component. In a downhole environment, the cuttings (e.g., from metal or alloy portions of a plug) and debris (e.g., produced from elastomers, rubber, or composites of the plug) may be of a size that can be conveyed to the surface through drilling fluid within the annulus between the milling system 400 and the casing of the wellbore. In other embodiments, the cuttings or debris, or a portion thereof, may have a size or shape that is not easily conveyed to the surface, or the milling system may be used outside a downhole environment.

As discussed herein, the debris conditioning system 430 may be used to reduce the number of short-trips used to avoid clogging a wellbore by, for instance, re-milling, re-grinding, re-shaping, or otherwise conditioning the cuttings and debris within the wellbore. As discussed herein, one mechanism for conditioning the debris or other cuttings may include the use of a barrier that promotes re-circulation of cuttings to the face of the mill 416. Another mechanism may include one or more secondary attrition systems 452 for re-milling or re-grinding cuttings and debris away from the face of the mill 416. Such mechanisms may be used in combination or in isolation. For instance, the milling system may include nozzles 436 that may be defined in the body or stem of the mill 416, in the drive shaft extension 444-2, or in some other component of the milling system 400, and which may act as control jets for promoting re-circulation of the cuttings and debris to the face of the mill 416. For instance, as discussed herein, the nozzles 436 may be used to form a fluid shroud, curtain, or other barrier to restrict, and potentially prevent, cuttings or debris above a predetermined size from moving uphole past the fluid or hydraulic barrier and toward the surface. In particular, the fluid curtain or other barrier may limit the size of cuttings that may pass uphole and to re-direct larger cuttings back to the face of the mill 416 for re-grinding and re-milling by the cutting elements thereon.

FIGS. 4-1 and 4-2 illustrate an embodiment in which the milling system includes both a barrier (e.g., as formed by nozzles 436) and a secondary attrition system 452; however, other embodiments may include a barrier without the secondary attrition system 452, or the secondary attrition system 452 without a barrier.

In at least some aspects, embodiments of downhole milling systems described herein may be used to reduce the time to complete a plug or other milling operation. Such reduction may occur as a result of reducing size of the cuttings and debris generated, thereby reducing the number of short trips made in a milling operation while continuing to effectively clean and remove debris from a wellbore. The downhole milling system may also operate in environments (e.g., coiled tubing) in which flow rate limitations may limit efficient solid transport of larger cuttings to the surface.

As should be appreciated by a person having ordinary skill in the art, a milling system of the present disclosure may be adapted for use in a variety of applications and may be sized for operation specific to a particular environment. For instance, embodiments of the milling system 400 may be sized differently even for different downhole environments. By way of example, the mill 416 may be designed to operate within a wellbore having a diameter between 2 inches (5.1 cm) and 24 inches (61.0 cm). As such, the gauge diameter of the mill 416 may also be about equal to the diameter of the wellbore, or may be undersized relative to the wellbore. The mill 416 could therefore have a gauge diameter between 1 inch (2.5 cm) and 24 inches (61.0 cm). The sleeve 448 could similarly be sized based on a diameter of the wellbore. In at least some embodiments, a diameter of the sleeve 448 may be about equal to a gauge diameter of the mill 416. Accordingly, the sleeve 448 may have a diameter between 1 inch (2.5 cm) and 24 inches (61.0 cm). In other embodiments, the sleeve 448 may have a diameter less than the gauge diameter of the mill 416, or greater than the diameter of the mill 416.

Various other dimensions of the sleeve 446 or other components of the milling system 400 may also vary in different embodiments. For instance, the axial length of the portion of the lower end 468 of the sleeve 448 along which the cutting elements 454 are located may vary. For instance, in some embodiments, the cutting elements 454 may extend axially along a length that is between 1 inch (2.5 cm) and 20 inches (50.8 cm), but in other embodiments the axial length may be less than 1 inch (2.5 cm) or greater than 20 inches (50.8 cm). The length of the sleeve 448 may therefore also be modified. In at least some embodiments, for instance, the length of the sleeve 448 may be between 5 inches (12.7 cm) and 120 inches (304.8 cm). The length of any drive shaft extension 444-2 may similarly vary, and in some embodiments may be between 5 inches (12.7 cm) and 60 inches (152.4 cm).

In a more particular embodiment in which the milling system 400 is a downhole milling system, the mill 416 may have a gauge diameter between 3 inches (10.2 cm) and 6 inches (15.2 cm). For instance, the mill 416 may have a gauge diameter of 4.6 inches (11.7 cm). The outer diameter of the sleeve 448 may also be between 3 inches (10.2 cm) and 6 inches (15.2 cm). For instance, the outer diameter of the sleeve 448 may be 4.4 inches (11.2 cm). An inner diameter of the sleeve 448 may be between 2 inches (5.1 cm) and 5.5 inches (14.0 cm).

The cutting elements 454 may extend axially between 1 inch (2.5 cm) and 6 inches (15.2 cm) along the interior surface of the lower end 468 of the sleeve 448. In some embodiments, the axial distance covered by the cutting elements 454 may be less than 4 inches (10.2 cm). The cutting elements 454 may also extend radially inward from the inner surface of the sleeve 448. That radial distance may vary, and may be between 0.1 inch (2.5 mm) and 1 inch (25.4 mm). In a more particular example, the cutting elements 454 may extend radially inward a distance of 0.25 inch (6.4 mm). A radial/annular separation or gap between the cutting elements 454 and the drive shaft extension 444-2 may be used, at least in part, to define the maximum size of cuttings or debris that may flow uphole of the sleeve 448. As discussed herein, the width of the annular or radial gap may be variable (e.g., using a tapered inner surface of the sleeve 448 and/or tapered outer surface of the drive shaft extension 444-2). In some embodiments, the minimum distance between the inner position of the cutting elements 454 and the outer surface of the drive shaft extension 444-2 may be between 0.1 inch (2.5 mm) and 2 inches (50.8 mm). For instance, the minimum distance may be 0.3 inch (7.6 mm). Additionally, as noted herein, the outer drive surface of the drive shaft extension 444-2 may also have cutting elements thereon to further reduce the annular or radial gap between drive shaft extension 444-2 and the sleeve 448.

In at least some embodiments, the drive shaft extension 444-2 may be tapered, and a tapered section 470 may be longitudinally aligned with the cutting elements 454. In at least some embodiments, the tapered section 470 may have a minimum diameter between 1.5 inches (3.8 cm) and 5.0 inches (12.7 cm). A maximum diameter of the tapered section 470 may be between 1.8 inches (4.6 cm) and 5.3 inches (13.5 cm). For instance, the maximum diameter of the tapered section 470 may be 2.9 inches (7.4 cm). Additional dimensions should be appreciated in view of the present disclosure, and particularly in view of FIG. 4-2 which is drawn to scale for some embodiments of the present disclosure. Other embodiments are contemplated, however, for which FIG. 4-2 is not drawn to scale.

In the description herein, various relational terms are provided to facilitate an understanding of various aspects of some embodiments of the present disclosure. Relational terms such as "bottom," "below," "top," "above," "back," "front," "left," "right," "rear," "forward," "up," "down," "horizontal," "vertical," "clockwise," "counterclockwise," "upper," "lower," "uphole," "downhole," and the like, may be used to describe various components, including their operation and/or illustrated position relative to one or more other components. Relational terms do not indicate a particular orientation for each embodiment within the scope of the description or claims. For example, a component of a BHA that is described as "below" another component may be further from the surface while within a vertical wellbore, but may have a different orientation during assembly, when removed from the wellbore, or in a deviated borehole. Accordingly, relational descriptions are intended solely for convenience in facilitating reference to various components, but such relational aspects may be reversed, flipped, rotated, moved in space, placed in a diagonal orientation or position, placed horizontally or vertically, or similarly modified. Certain descriptions or designations of components as "first, " "second," "third," and the like may also be used to differentiate between identical components or between components which are similar in use, structure, or operation. Such language is not intended to limit a component to a singular designation. As such, a component referenced in the specification as the "first" component may be the same or different than a component that is referenced in the claims as a "first" component.

Furthermore, while the description or claims may refer to "an additional" or "other" element, feature, aspect, component, or the like, it does not preclude there being a single element, or more than one, of the additional or other element. Where the claims or description refer to "a" or "an" element, such reference is not be construed that there is just one of that element, but is instead to be inclusive of other components and understood as "at least one" of the element. It is to be understood that where the specification states that a component, feature, structure, function, or characteristic "may," "might," "can," or "could" be included, that particular component, feature, structure, or characteristic is provided in some embodiments, but is optional for other embodiments of the present disclosure. The terms "couple," "coupled," "connect," "connection," "connected," "in connection with," and "connecting" refer to "in direct connection with," or "in connection with via one or more intermediate elements or members." Components that are "integral" or "integrally" formed include components made from the same piece of material, or sets of materials, such as by being commonly molded or cast from the same material, or machined from the same one or more pieces of material stock. Components that are "integral" should also be understood to be "coupled" together.

Although various example embodiments have been described in detail herein, those skilled in the art will readily appreciate in view of the present disclosure that many modifications are possible in the example embodiments without materially departing from the present disclosure. Accordingly, any such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in any combination.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

While embodiments disclosed herein may be used in oil, gas, or other hydrocarbon exploration or production environments, such environments are merely illustrative. Systems, tools, assemblies, methods, milling systems, and other components of the present disclosure, or which would be appreciated in view of the disclosure herein, may be used in other applications and environments. In other embodiments, milling tools, hydraulic or fluid barriers, debris conditioning systems, secondary attrition systems, methods of milling, or other embodiments discussed herein, or which would be appreciated in view of the disclosure herein, may be used outside of a downhole environment, including in connection with other systems, including within automotive, aquatic, aerospace, hydroelectric, manufacturing, other industries, or even in other downhole environments. The terms "well," "wellbore," "borehole," and the like are therefore also not intended to limit embodiments of the present disclosure to a particular industry. A wellbore or borehole may, for instance, be used for oil and gas production and exploration, water production and exploration, mining, utility line placement, or myriad other applications.

Certain embodiments and features may have been described using a set of numerical values that may provide lower and upper limits. It should be appreciated that ranges including the combination of any two values are contemplated unless otherwise indicated, and that a particular value may be defined by a range having the same lower and upper limit. Numbers, percentages, ratios, measurements, or other values stated herein are intended to include the stated value as well as other values that are about or approximately the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least experimental error and variations that would be expected by a person having ordinary skill in the art, as well as the variation to be expected in a suitable manufacturing or production process. A value that is about or approximately the stated value and is therefore encompassed by the stated value may further include values that are within 10%, within 5%, within 1%, within 0.1%, or within 0.01% of a stated value.

The Abstract included with this disclosure is provided to allow the reader to quickly ascertain the general nature of some embodiments of the present disclosure. The Abstract is submitted with the understanding that it will not be used to interpret or limit the scope or meaning of the claims.

What is claimed is:

1. A secondary attrition system for a milling system, comprising:

a sleeve having an inner surface and an outer surface;

a tubular component within the sleeve and rotationally connected to the sleeve, the tubular component having an outer surface cooperating with the inner surface of the sleeve to define a gap having a variable width along at least a portion of a length of the tubular component; and at least one cutting element coupled to the inner surface of the sleeve or the outer surface of the tubular component and the at least one cutting element located within the gap.

2. The secondary attrition system of claim 1, the tubular component including a drive shaft.

3. The secondary attrition system of claim 2, the drive shaft being a drive shaft of a downhole motor.

4. The secondary attrition system of claim 2, the drive shaft including a drive shaft extension.

5. The secondary attrition system of claim 1, the tubular component including a drill string.

6. The secondary attrition system of claim 1, a tapered section of the outer surface of the tubular component defining at least a portion of the gap having the variable width.

7. The secondary attrition system of claim 1, a tapered section of the inner surface of the sleeve defining at least a portion of the gap having the variable width.

8. The secondary attrition system of claim 1, the tubular component being configured to rotate relative to the sleeve.

9. A secondary attrition system for a milling system, comprising:

a first tubular member having an inner surface and an outer surface, a second tubular member having an inner surface and an outer surface, the second tubular member being coupled to the first tubular member and at least partially disposed within the first tubular member to form an annulus between the outer surface of the second tubular member and the inner surface of the first tubular member;

a first opening allowing for flow of drilling fluid and milling debris into the annulus;

a second opening allowing for flow of drilling fluid and milling debris out of the annulus;

at least one cutting element located within the annulus and coupled to the inner surface of the first tubular member or to the outer surface of the second tubular member; and wherein milling debris flowing into the annulus is reduce in size by the at least one cutting element prior to flowing out of the annulus through the second opening.

10. The secondary attrition system of claim 9, wherein the first tubular member has an outer diameter of 3 inches to 6 inches.

11. The secondary attrition system of claim 9, wherein the first tubular member has an inner diameter of 2 inches to 5.5 inches.

12. The secondary attrition system of claim 9, wherein the first opening is configured to allow milling debris of a first predetermined size to pass through the first opening;

the second opening is configured to allow milling debris of a second predetermined size to pass through the second opening; and the second predetermined size is smaller than the first predetermined size.

13. The secondary attrition system of claim 9, wherein the second tubular member is configured to rotate relative to the first tubular member.

14. The secondary attrition system of claim 9, wherein the width of the annulus has a variable width.

15. The secondary attrition system of claim 14, wherein the width of the annulus is tapered.

16. The secondary attrition system of claim 15, wherein the taper of the annulus comprises a linear taper, a parabolic taper, or a stepped taper.

17. The secondary attrition system of claim 9, wherein the at least one cutting element comprises hardfacing, crushed carbide, or a cutting insert.

* * * * *